US007134616B2

(12) United States Patent
Dong et al.

(10) Patent No.: US 7,134,616 B2
(45) Date of Patent: Nov. 14, 2006

(54) FUEL INJECTOR WITH AUXILIARY VALVE

(75) Inventors: Mingchun Dong, Bloomington, IL (US); Dana R. Coldren, Fairbury, IL (US); Daniel R. Ibrahim, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 305 days.

(21) Appl. No.: 10/755,626

(22) Filed: Jan. 12, 2004

(65) Prior Publication Data

US 2005/0150972 A1 Jul. 14, 2005

(51) Int. Cl.
*F02M 47/02* (2006.01)
*F02M 41/16* (2006.01)
*F02M 61/20* (2006.01)

(52) U.S. Cl. ..... 239/533.8; 239/88; 239/96; 239/533.9; 239/5

(58) Field of Classification Search ..... 239/533.8, 239/88, 96, 533.9, 5, 89–92, 95, 533.2, 533.3
See application file for complete search history.

(56) References Cited

U.S. PATENT DOCUMENTS 4,440,135 A 4/1984 Asami
4,471,740 A 9/1984 Jourde et al.
4,475,515 A 10/1984 Mowbray
4,598,863 A 7/1986 Kanesaka
4,653,455 A 3/1987 Eblen et al.
4,779,599 A 10/1988 Phillips
4,793,315 A 12/1988 Phillips
4,911,127 A 3/1990 Perr
5,522,364 A 6/1996 Knight et al.
5,533,672 A 7/1996 Peters
5,685,490 A 11/1997 Ausman et al.
5,711,279 A 1/1998 Green et al.
5,785,021 A 7/1998 Yudanov et al.
5,819,704 A 10/1998 Tarr et al.
5,860,597 A 1/1999 Tarr
5,865,373 A 2/1999 Buckley et al.
5,913,300 A 6/1999 Drummond
5,984,201 A 11/1999 Hofmann et al.
6,012,430 A 1/2000 Cooke
6,092,744 A 7/2000 Youakim
6,113,014 A * 9/2000 Coldren et al. ..... 239/585.1
6,119,959 A 9/2000 Smith, III et al.
6,119,962 A 9/2000 Youakim et al.
6,168,087 B1 * 1/2001 Cooke ..... 239/1
6,213,093 B1 4/2001 Yudanov et al.

(Continued)

*Primary Examiner*—Davis Hwu
*Assistant Examiner*—Darren Gorman
(74) *Attorney, Agent, or Firm*—Liell & McNeil

(57) ABSTRACT

A fuel injector includes an auxiliary valve member that can assist in raising a mean injection pressure, increase a nozzle valve opening pressure, and hasten the closure rate of a nozzle valve member over an equivalent fuel injector without the auxiliary valve. The auxiliary valve member is fluidly positioned between a needle control chamber and a high pressure space, which includes a fuel pressurization chamber within the fuel injector. The auxiliary valve member includes a closing hydraulic surface exposed to fluid pressure in the high pressure space. The plumbing and the auxiliary valve member allow high pressure fuel to act upon a closing hydraulic surface of the nozzle valve member to increase valve opening pressure and mean injection pressure. The needle control chamber may be vented or may be a closed volume when the auxiliary valve member is in its closed position. The invention is potentially applicable to any fuel injector, but finds the preferred application in cam actuated fuel injectors that include an electronically controlled spill valve.

19 Claims, 4 Drawing Sheets

U.S. PATENT DOCUMENTS 6,412,706 B1 * 7/2002 Guerrassi et al. ..... 239/96
6,460,515 B1 10/2002 Askew
2003/0111560 A1 * 6/2003 Bartkowiak et al. ..... 239/533.9

* cited by examiner 1
0
INVENTION 70
71
$P_{22'}$
INVENTION 1
0
INVENTION $P_{30'}$
INVENTION 1
0
INVENTION

Q
INVENTION
PRIOR ART

FUEL INJECTOR WITH AUXILIARY VALVE

TECHNICAL FIELD

The present invention relates generally to fuel injectors that cycle between high and low pressure states, and more particularly to an auxiliary valve member in such a fuel injector to improve a performance parameter, such as an increased mean injection pressure or an increased nozzle valve opening pressure.

BACKGROUND

In one class of fuel injector, a plunger is driven downward within the injector to pressurize fuel for each injection event. Between injection events, the plunger retracts and the fuel injector returns to a relatively low pressure state. The plunger can be driven to move in any of a number of ways including via a rotating cam or possibly even via hydraulic fluid pressure from a common rail. In many instances, the plunger and the nozzle portion of the fuel injector are housed in a common injector body. In other instance, these two functions are separated with each nozzle assembly having a dedicated unit pump. In any event, those skilled in the art have generally come to recognize that higher injection pressure levels can generally be exploited to reduce undesirable engine emissions, including but not limited to NOx. unburned hydrocarbons and soot. Most of these fuel injectors include a nozzle valve member that moves between positions that either open or close the nozzle outlets to facilitate spray of fuel into an engine cylinder. These nozzle valve members are usually biased toward their closed position by a compressed biasing spring, but other biasing strategies are available such as by using hydraulic fluid pressure to bias the nozzle valve member toward its closed position. By carefully choosing a pre-load on the biasing spring and adjusting surface areas on the nozzle valve member, along with the possible use of a shim, a valve opening pressure for the nozzle valve member can be reliably and consistently set among a group of fuel injectors. However, there are often urges to increase the valve opening pressure of the nozzle valve member, but doing so by increasing the pre-load on the biasing spring can be problematic. Simply increasing the pre-load on the biasing spring can undermine the fuel injector's ability to inject relatively small amounts of fuel, especially when the engine is operating at a low speed and load condition.

Since the nozzle valve member biasing springs of the prior art inherently bias the nozzle valve member to the same magnitude across the engine operating range, there is also inherently some compromise in choosing a valve opening pressure for the nozzle valve member via a biasing spring pre-load. Those skilled in the art recognize that optimizing the biasing spring pre-load for low speed and low load operating conditions can be entirely different than optimizing the spring pre-load for high speed and load operating conditions. On one hand, excessively low injection pressures can lead to increased production of undesirable engine emissions, while on the other hand, elevated injection pressures can introduce variability issues among fuel injectors via a difficulty in making injectors behave consistently. Thus, there is often a conflict between maintaining acceptable controllability and minimizing variability among fuel injectors verses a motivation to increase mean injection pressure levels and/or the nozzle valve member's valve opening pressure.

The present invention is directed to one or more of the problems set forth above.

SUMMARY OF THE INVENTION

In one aspect, a fuel injector includes an injector body with a needle control chamber and a high pressure space that includes a fuel pressurization chamber. A nozzle valve member has a first closing hydraulic surface exposed to fluid pressure in the needle control chamber. An auxiliary valve member is positioned in the injector body, and is moveable between an open position in which the high pressure space is fluidly connected to the needle control chamber, and a closed position in which the high pressure space is blocked to the needle control chamber. The auxiliary valve member includes a second closing hydraulic surface exposed to fluid pressure in the high pressure space. A biasing spring is operably coupled to bias the auxiliary valve member toward its open position.

In another aspect, a method of increasing nozzle valve opening pressure in a fuel injector includes a step of setting a base valve opening pressure at least in part by biasing a nozzle valve member toward a closed position with a biasing spring. Fuel pressure is increased in a high pressure space of the fuel injector for an injection event. A fluid connection between a high pressure space and a needle control chamber is closed at least in part by exposing a closing hydraulic surface of an auxiliary valve member to fluid pressure in the high pressure space. A closing hydraulic surface of a nozzle valve member is exposed to fluid pressure in the needle control chamber. Finally, a nozzle valve opening pressure is increased above the base valve opening pressure at least in part by biasing the auxiliary valve member to open a fluid connection between the high pressure space and the needle control chamber during the increasing fuel pressure step.

In still another aspect, a method of increasing mean injection pressure for a fuel injection event includes a step of opening a fluid connection between a high pressure space and a needle control chamber while fuel pressure is increasing in a fuel injector for an injection event. A closing hydraulic surface of a nozzle valve member is exposed to fluid pressure in the needle control chamber. The fluid connection between the high pressure space and the needle control chamber is closed before the nozzle valve member moves from a closed position toward an open position, at least in part by exposing a closing hydraulic surface of an auxiliary valve member to fluid pressure in the high pressure space.

DETAILED DESCRIPTION

Figure 1:
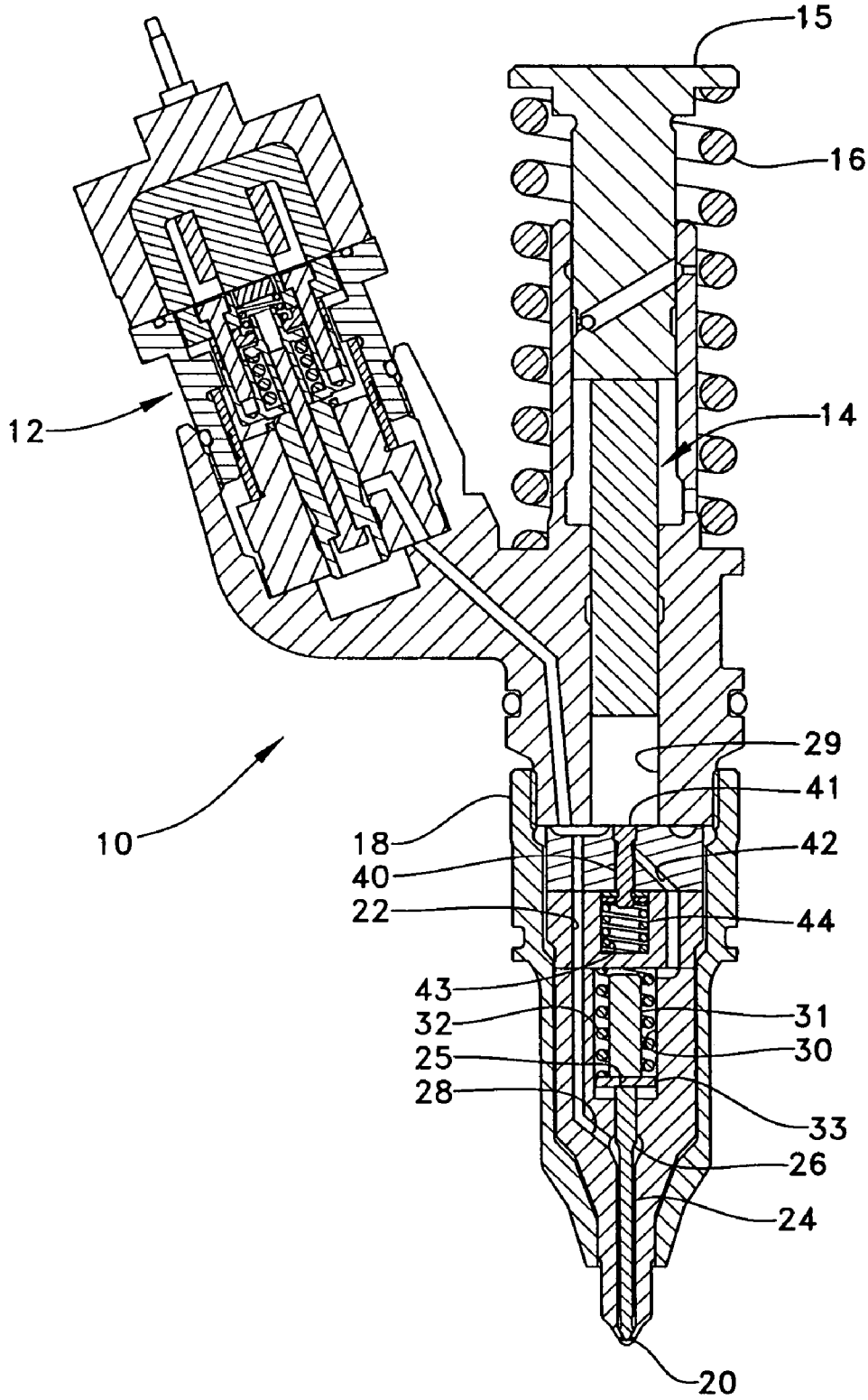
FIG. 1 is a sectioned side diagrammatic view of a fuel injector according to one embodiment of the present invention.

Referring to FIG. 1, a fuel injector 10 includes an injector body 18 made up of a plurality of assembled components to includes a moveable plunger 14 that partially defines a fuel pressurization chamber 29. Although the illustrated embodiment shows plunger 14 being cam actuated via a tappet 15, those skilled in the art will appreciate that plunger 14 could also be driven downward via hydraulic pressure via a hydraulically actuated piston of a type well known in the art. In addition, those skilled in the art will appreciate that the pressurization and injection aspects of the fuel injection system can be separated such that a nozzle assembly is fluidly connected to a dedicated unit pump of a type well known in the art. Pressure control in fuel injector 10 is maintained by an electronically controlled spill valve 12. Generally, electronically controlled spill valve 12 is biased open such that downward movement of plunger 14 simply recirculates fuel back to a low pressure supply line (not shown). When pressure is desired for an injection event, an electrical actuator is energized, which causes the spill valve 12 to close and allow pressure to build in fuel pressurization chamber 29 for an injection event. Thus, electronically controlled spill valve 12 can be thought of a pressure control valve. In the case of an alternative embodiment in which the plunger is driven via hydraulic actuation, the pressure control valve might take the form of a flow control valve that either opens or closes a piston actuation cavity to a source of high pressure actuation fluid. Between injection events, a return spring 16 retracts tappet 15 to its retracted position as shown, while relatively low fuel pressure pushes plunger 14 toward contact with tappet 15 to refill fuel pressurization chamber with fuel for a subsequent injection event. Nevertheless, those skilled in the art will appreciate that plunger 14 could be coupled to tappet 15 in a way that causes return spring 16 to pull both tappet 15 and plunger 14 toward the retracted position together.

During an injection event when plunger 14 is being driven downward, a high pressure space 22 is created within injector body 18 that includes fuel pressurization chamber 29 and nozzle supply passage 28. Those skilled in the art will appreciate that as used in this patent document, the term injector body can include a combination of a nozzle body a unit pump body and the conduit connecting the two. When fuel pressure in the high pressure space exceeds a valve opening pressure acting on opening hydraulic surface 26, nozzle valve member 24 will lift upward toward its open position to fluidly connect nozzle outlets 20 to nozzle supply passage 28 to commence spray of fuel into a combustion space. A lift spacer 31 determines the maximum lift of nozzle valve member 24. Nozzle valve member 24 is normally biased downward toward its closed position, as shown, by a biasing spring 32, which is chosen to have a predetermined pre-load that is trimmed via a VOP spacer 33. Biasing spring 32 is positioned in a needle control chamber 30 within which a closing hydraulic surface 25 of nozzle valve member 24 is exposed to fluid pressure. Needle control chamber 30 is fluidly connected to fuel pressurization chamber 29 via a pressure communication passage 42. Needle control chamber 30 may be a closed chamber except for the pressure communication passage 42, or may in an alternative embodiment be vented to a low pressure space via a restricted passage as more thoroughly discussed in relation to the embodiment of FIG. 3. Thus, the valve opening pressure for nozzle valve member 24 is the sum of the biasing force from biasing spring 32 (base valve opening pressure) plus the hydraulic force, if any, acting on closing hydraulic surface 25. The inclusion of pressure communication passage 42 allows pressurized fuel from fuel pressurization chamber 29 to be transmitted to needle control chamber 30 to elevate the hydraulic pressure force aspect of the valve opening pressure for nozzle valve member 24.

Fuel injector 10 also includes an auxiliary valve member 40 that is positioned in injector body 18 to open and close pressure communication passage 42 to fuel pressurization chamber 29. Auxiliary valve member 40 is normally biased upward so that valve surface 46 is out of contact with valve seat via a biasing spring 44 that is positioned in a spring chamber 43. Spring chamber 43 is preferably vented via a vent passage (not shown). When fuel pressure in fuel pressurization chamber 29 acting on closing hydraulic surface 41 exceeds a valve closing pressure, auxiliary valve member 40 will move downward to close valve seat 47 and isolate needle control chamber 30 from the high pressure space 22, which includes fuel pressurization chamber 29. Those skilled in the art will recognize that the valve closing pressure for auxiliary valve member 40 can be set by choosing an appropriate pre-load on biasing spring 44 relative to the area of closing hydraulic surface 41. Preferably, the valve closing pressure for auxiliary valve member 40 can be set to produce a variety of performance improvements in fuel injector 10. The auxiliary valve member 40 also inherently includes a valve opening pressure that can be set to create certain desirable effects, such as at the end of an injection event. Those skilled in the art will appreciate that the valve opening pressure and the valve closing pressure for auxiliary valve member 40 are likely relatively close in magnitude, but need not necessarily be.

As an example, the valve closing pressure for nozzle valve member 40 could be set to be lower than the base valve opening pressure (spring alone) for nozzle valve member 24. In such a way, auxiliary valve member 40 would move downward and close valve seat 47 before nozzle valve member 24 lifted for an injection event. This would allow pressurized fuel to be trapped in needle control chamber 30, which would elevate the closing force acting on nozzle valve member 24, thus raising its valve opening pressure and delaying a start of injection over the like fuel injector not equipped with an auxiliary valve member according to the present invention. The valve opening pressure for the auxiliary valve member 40 could also be set to be below the base valve closing pressure for nozzle valve member 24. In this way, to affect end of injection characteristics, including the possibility of hastening the closure rate of nozzle valve member 24 as discussed more thoroughly infra.

Figure 3:
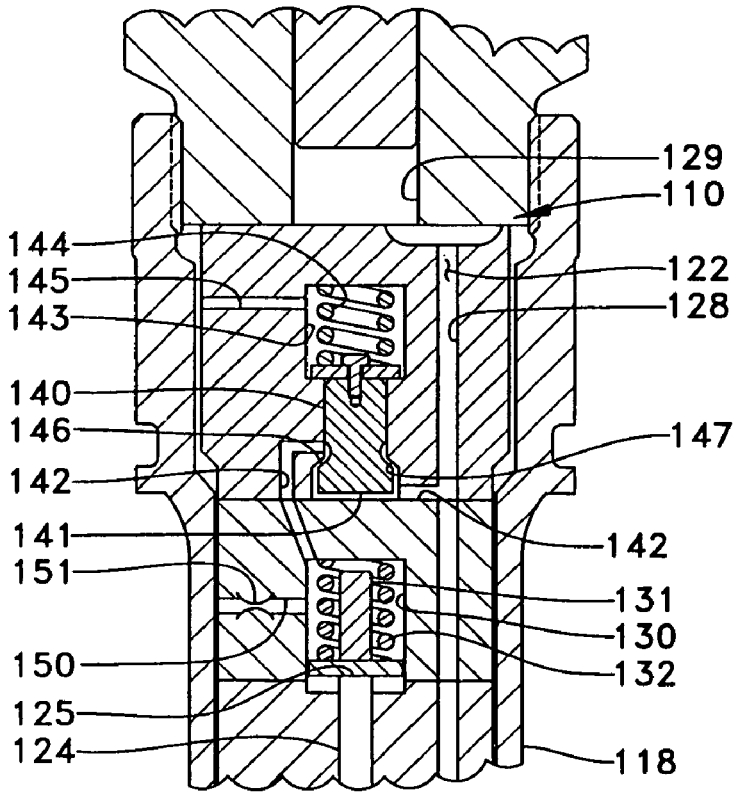
FIG. 3 is a sectioned side diagrammatic view of the auxiliary valve portion of a fuel injector according to another embodiment of the present invention.

Referring now to FIG. 3, a fuel injector 110 is nearly identical to fuel injector 10 of FIG. 1 except that its auxiliary valve member 140 has a closing hydraulic surface 141 exposed to fluid pressure in nozzle supply passage 128 via a segment of a pressure communication passage 142. Thus, fuel injector 110 is similar to fuel injector 10 described earlier in that its auxiliary valve member 140 has a closing hydraulic surface 141 exposed to fluid pressure in the high pressure space 122 in the fuel injector. That closing hydraulic surface 141 is exposed to fluid pressure in the nozzle supply passage 128 portion of high pressure space 122, rather than fuel pressurization chamber 129 as in the embodiment of FIG. 1. This embodiment also differs from the embodiment of FIG. 1 due to the inclusion of a vent passage 150 that fluidly connects needle control chamber 130 to a low pressure space. However, vent passage 150 includes a restriction orifice 151 that slows the rate at which pressure can decay in needle control chamber 130. The inclusion of vent passage 150 can create different effects from those available with an unvented needle control chamber as in the previous embodiment. For instance, fuel injector 110 and fuel injector 10 could perform substantially similarly at the beginning of an injection event by raising the valve opening pressure for their respective nozzle valve members; however, that initial pressure increase in the needle control chamber would decay during injection event in the case of the embodiment of FIG. 3, whereas that increase pressure would remain trapped in the needle control chamber in the previous embodiment.

Those skilled in the art will appreciate that the injector body segment 118 for the fuel injector 110 could be substituted into a like segment of the fuel injector 10 to produce a complete fuel injector according to the present invention. Fuel injector 110 includes an injector body 118 that has deposed therein a high pressure space 122 that includes a nozzle supply passage 128 and a fuel pressurization chamber 129. A nozzle valve member 124 is normally biased downward to close the nozzle outlets (not shown) via a biasing spring 132 that is positioned in needle control chamber 130. Like the previous embodiment, a valve lift spacer 131 control the maximum lift of nozzle valve member 124. Nozzle valve member 124 includes a closing hydraulic surface 125 exposed to fluid pressure in needle control chamber 130.

Auxiliary valve member 140 is normally biased downward so that valve surface 146 is out of contact with valve seat 147 via a biasing spring 144 that is positioned in spring chamber 143. Spring chamber 143 is vented to prevent possible hydraulic locking via a vent passage 145. Like the previous embodiment, auxiliary valve member 140 opens and closes the pressure communication passage 142 that fluidly connects needle control chamber 130 to high pressure space 122. When fuel pressure acting on closing hydraulic surface 41 exceeds a valve closing pressure for auxiliary valve member 140, it will move upward against spring 144 to close valve seat 147 and isolate needle control chamber 130 from the high pressure space 122. Like the previous embodiment, the valve opening and closing pressures for the auxiliary valve member 140 can be set to produce certain desirable effects, such as increasing mean injection pressure, increasing the nozzle valve member's valve opening pressure, and possibly even provide a means of assisting closure of the nozzle valve member 124 at the end of an injection event.

INDUSTRIAL APPLICABILITY

The present invention finds potential application in any fuel injector that cycles between high and low pressure during and between injection events. Such fuel injectors include cam actuated fuel injectors, hydraulically actuated fuel injectors and some common rail fuel injectors that are fluidly disconnected from the common rail between injection events. In addition, the present invention contemplates fuel injectors that consist of a nozzle connected to a unit pump, which combined are considered a fuel injector according to the present invention. However, those skilled in the art would appreciate that the present invention probably finds its best application in cam actuated fuel injectors of the type illustrated that include an electronically controlled spill valve. Although not illustrated, the present invention could also find potential application in fuel injectors that include direct control needle valves in which a second electrical actuator allows either high or low pressure to be applied to a closing hydraulic surface on the nozzle valve member, at will, when fuel pressure in the injector is high. Depending upon how the fuel injector is plumbed, such as the inclusion or not of a vent passage from the needle control chamber, a variety of improved performance effects can be achieved. Among these affects are the possibility of increasing a mean injection pressure for an injection event over a like fuel injector not equipped with an auxiliary valve member. In addition, another effect could be an increase in the valve opening pressure for the nozzle valve member. The present invention can also be exploited to provide a brief pressure pulse toward the end of an injection event to hasten the closure rate of the nozzle valve member. Finally, the present invention can also be exploited to increase the start of current-start of injection delay so as to provide more precise control over injection of small amounts of fuel. In other words, a fuel injector equipped with the present invention requires a spill control valve on time that is longer than a like injector not so equipped in order to inject a like amount of fuel.

Figures 4A, 4B, 4C, 4D, 4E, 4F:
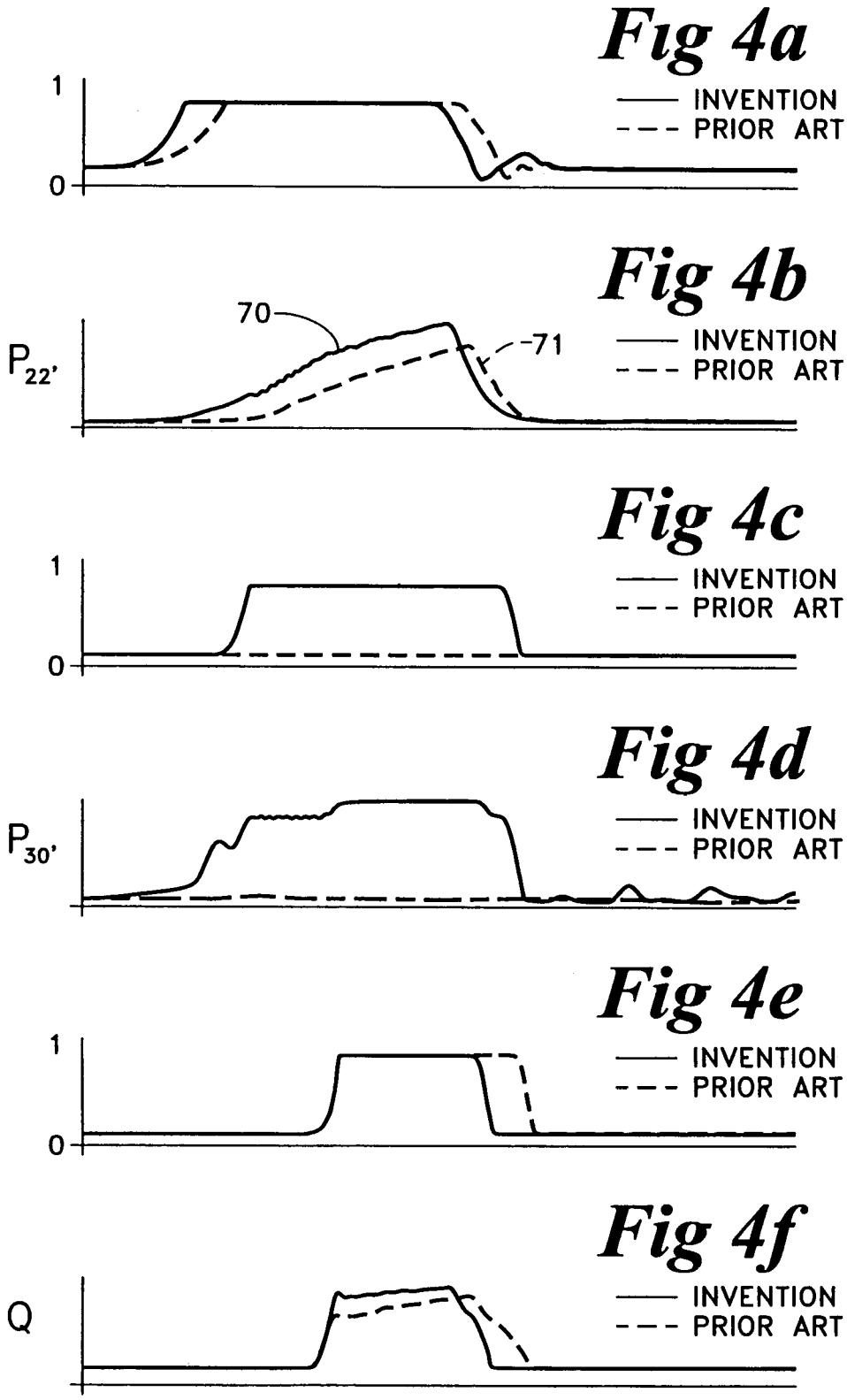
PRIOR ART Fig 4b
PRIOR ART Fig 4c
PRIOR ART Fig 4d
PRIOR ART Fig 4e
PRIOR ART Fig 4f
FIGS. 4*a–f* are graphs of control valve position, injector pressure, auxiliary valve position, needle control chamber pressure, nozzle valve member position and injection mass flow rate, respectively, verses engine crank angle for a sample fuel injection event according to the prior art and the present invention.

Referring now to FIGS. 4*a–f*, a series of graphs are useful in illustrating an example injection event for the fuel injector of FIG. 1 as compared to a like fuel injector not equipped with the auxiliary valve member 40 of the present invention. Before the fuel injection event begins, tappet 15 and plunger 14 are fully retracted, and low pressure prevails throughout fuel injector 10. This is reflected in graph 4*a* by showing spill valve 12 in its open position, FIG. 4*b* showing the pressure in high pressure space 22 to be low at this time. FIG. 4*c* shows the auxiliary valve member 40 is in its biased open position. FIG. 4*d* shows that the pressure in needle control chamber 30 is low at this time. FIG. 4*e* shows that the nozzle valve member 24 remains in its downward closed position, and FIG. 4*f* shows that no fuel injection has yet taken place. As the cam (not shown) continues to rotate, the lobe eventually arrives to move tappet 15 and plunger 14 downward to displace fuel from fuel pressurization chamber 29. However, no substantial pressure increase will occur in the fuel injector as long as spill control valve 12 is in its biased open position. When it is time to commence an injection event and raise fuel pressure in the fuel injector, FIG. 4*a* shows that an injection event is initiated by energizing the electrical actuator associated with spill control valve 12 to close the spill control valve as shown in FIG. 4*a* when the value changes from 0 to 1, with 1 representing a closed spill valve. When this occurs, fuel pressure within the fuel injector immediately begins to start rising as shown by the graphs of FIGS. 4*b* and 4*d*, which represent pressure in high pressure space 22 and needle control chamber 30, respectively. However, it should be noted that in the case of the prior art fuel injector, FIG. 4*d* shows that the pressure in its needle control chamber remains low because of a lack of fluid connection between it and any high pressure space in the fuel injector. As the plunger continues to travel downward, fuel pressure ramps up as shown by the invention pressure trace 70, and as also shown by the prior art pressure trace 71. FIG. 4*c* shows that at a certain valve closing pressure, the auxiliary valve member 40 moves from its open position to its closed position, which was represented by the numeral 1 in the graph. This action occurs before the nozzle valve member, which is shown in FIG. 4*e*, has lifted to its open position. Thus, elevated pressure in the needle control chamber 30, as shown by the pressure trace in FIG. 4*d*, increases the force tending to hold the nozzle valve member 24 in its downward closed position. Thus, an elevated valve opening pressure is achieved since the nozzle valve member 24 is being held closed both by its biasing spring (base valve opening pressure) and a hydraulic force that is trapped in needle control chamber 30. As the injection event continues, fuel pressure continues to rise and eventually reaches the elevated valve opening pressure for the nozzle valve member 24, and it lifts to its open position as shown in FIG. 4*e* to commence the spraying of fuel as shown by the rate trace in FIG. 4*f*. When it comes time to end the injection event, the electrical actuator associated with the spill control valve is de-energized allowing it to move from its closed position to its open position to vent high pressure fuel in the fuel injector to drain. This causes a relatively abrupt drop in fuel pressure as shown in FIG. 4*b* which results in the nozzle valve member 24 moving quickly toward its closed position before the auxiliary valve member moves to its open position as shown by FIGS. 4*e* and 4*c*, respectively. This demonstrates one subtle capability of the present invention in that the trapped high pressure in the needle control chamber 30 as shown by FIG. 4*d* causes the nozzle valve member 24 to move very quickly toward its closed position at the end of an injection event due to the combined force of fuel pressure acting on closing hydraulic surface 25 along with the force from biasing spring 32. On the other hand, the prior art fuel injector needle moves more gradually toward its closed position since its nozzle valve member does not move toward a closed position until fuel pressure drops below the valve closing pressure for the nozzle valve member due to spillage through spill valve 12. This more gradual closing is evidenced by the more gradual slope to the end of an injection event for the prior art as shown in FIG. 4*f*. This aspect of the invention illustrates that the valve closing pressure for nozzle valve member 24 is also substantially affected by the presence of auxiliary valve member 40 in the fuel injector. Thus, the present invention also provides a capability to affect the valve closing pressure of nozzle valve member 24 to create certain desirable effects in an injection event.

Even without the necessity to integrate the area underneath the pressure curves of FIG. 4*b*, one can quickly see that the mean injection pressure, as well as the maximum injection pressure are both increased for the fuel injector equipped with the auxiliary valve member of the present invention. In addition, the unvented needle control chamber 30 of the embodiment of FIG. 1 also assists in a hastened closure rate for the nozzle valve member at the end of the injection event. Those skilled in the art should appreciate that the graphs of FIGS. 4*a–f* have been adjusted timing wise so that the injection events of the prior art and according to the present invention begin at the same time in the graphs. This is accomplished by causing the spill control valve 12 to be closed earlier in the case of the present invention than would otherwise be required for an identical injection timing associated with a prior art fuel injector not equipped with the auxiliary valve member of the present invention. It is this aspect of the invention that can allow for improved accuracy and control when injecting relatively small quantities of fuel. For instance, because the delay between start of current to the spill control valve 12 verses start of injection is enlarged with the inclusion of the present invention, one has more ability to fully close and then shortly thereafter fully open the spill control valve in a controlled manner to precisely inject relatively small amounts of fuel at a controlled timing. An attempt to inject a similar small amount with the prior art fuel injector could be problematic in that for a similar small injection amount, the spill control valve may not even be allowed to be fully stopped at its closed position before being reopened to end a small injection event. In fact, a prior art fuel injection event may be so brief that the spill control valve member bounces off its seat in a manner that is not consistent or easily controlled among a group of fuel injectors. Thus, the present invention has the capability of increasing the valve opening pressure, increasing the mean injection pressure, increasing the maximum injection pressure, improving the ability to controllably inject smaller amounts of fuel, and finally has the capability of hastening the closure rate of nozzle valve member at the end of an injection event.

Figure 5A:
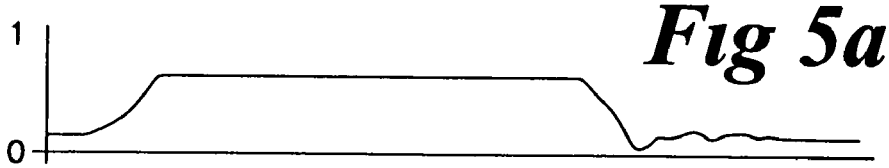
FIGS. 5*a–f* are graphs of control valve position, injector pressure, auxiliary valve member position, needle control chamber pressure, nozzle valve member position and injection flow rate verses engine crank angle for another example injection event according to another aspect of the present invention.
Figure 5B:
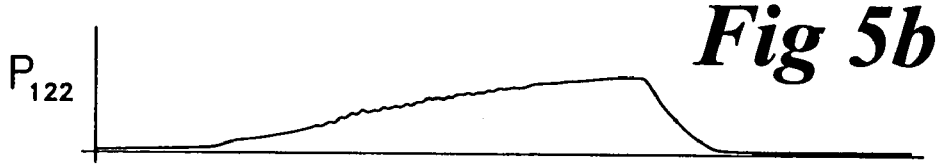
Figure 5C:
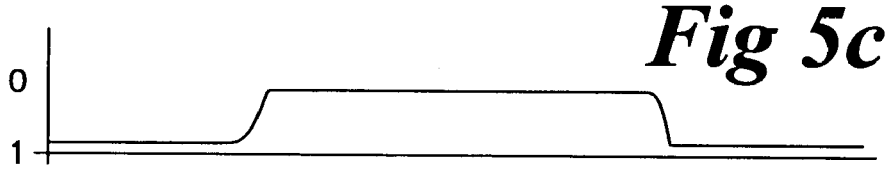
Figure 5D:
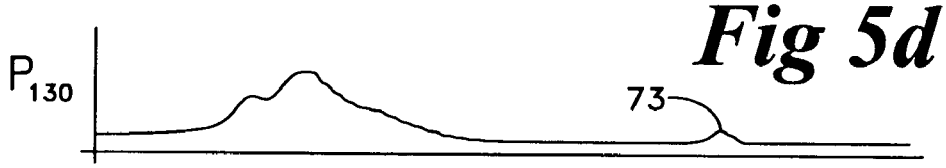
Figure 5E:
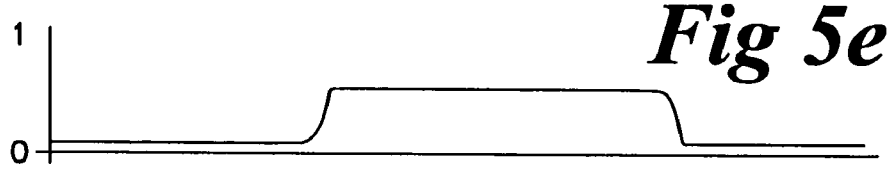
Figure 5F:
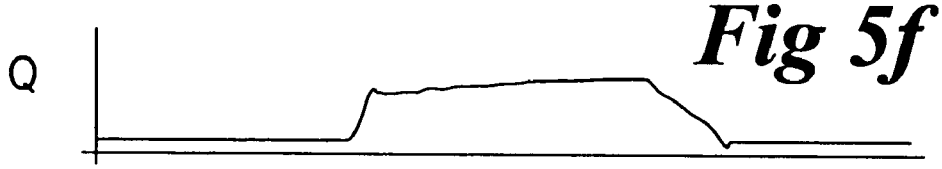

Referring now to FIGS. 5*a–5f*, a similar set of variables are graphed for an example injection event for the fuel injector 110 of FIG. 3, which includes a vented needle control chamber 130. The difference in performance is illustrated best in the graph of FIG. 5*d* which shows the pressure in needle control chamber 130 initially rising toward the beginning of the injection event to boost the valve opening pressure for the nozzle valve member, and then decaying during the injection event due to the inclusion of restrictive vent passage 150. In this embodiment, the auxiliary valve member 140 is set to have a valve opening pressure just lower than the valve closing pressure for the nozzle valve member 124. In this way, as fuel pressure is decreasing toward the end of an injection event due to the reopening of the spill control valve (FIG. 5*a*), this allows some residual pressure in the fuel injector to travel into needle control chamber 130 after the opening of auxiliary valve member 140 toward the end of an injection event. This is illustrated in FIG. 5*d* by a small pressure increase in the needle control chamber 130 toward the end of an injection event to provide a hydraulic boost to the closure rate of the nozzle valve member 124, which is shown in FIG. 5*e*. Thus, the vented needle control chamber embodiment of FIG. 3 results in the nozzle valve member 124 being moved toward its closed position primarily by its biasing spring 132, but with a pressure boost produced by the opening of the auxiliary valve member 140 just prior to the end of the injection event.

Figure 2:
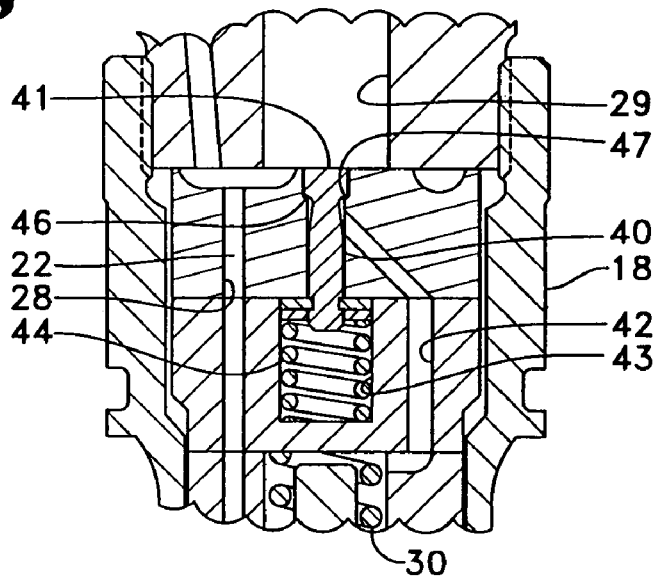
FIG. 2 is an enlarged side diagrammatic view of the auxiliary valve portion of the fuel injector of FIG. 1.

While the performance improvements of the first embodiment appear greater than that of the second embodiment, there are reasons for why one might consider venting the needle control chamber 130. For instance, since one can precisely control the area of the flow restriction 151, one can possibly make the fuel injectors according to the embodiment of FIG. 3 behave more consistently than fuel injectors of FIG. 1. For instance, this could be due to an uncertainty regarding a pressure decay rate in the closed needle control chamber 30 of FIGS. 1 and 2. For instance, there could be some uncertain and variable decay rate simply due to the fact that the needle control chamber 30 of the embodiment of FIGS. 1 and 2 is defined by a plurality of stacked components that may allow for some leakage that may vary among a group of apparently identical fuel injectors. Thus, the present invention allows for a means of balancing potential variability among fuel injectors against a performance increase that is possible with the present invention.

Although the present invention has been illustrated in the context of a cam actuated spill controlled fuel injector, those skilled in the art will appreciate that some of the advantages of the present invention can be achieved in other pressure varying fuel injectors, including but not limited to hydraulically actuated fuel injectors, unit pump fuel injectors, and possibly even some common rail fuel injection systems. Those skilled in the art will also appreciate that the magnitude which advantages are exploited can be varied to some extent by setting the valve opening and closing pressures for the auxiliary valve member 140 to certain desired magnitudes, especially relative to the base valve opening and closing pressures associated with the nozzle valve member 24, 124.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel injector comprising:

an injector body having disposed therein a needle control chamber and a high pressure space that includes a fuel pressurization chamber;

an electronically controlled pressure control valve attached to said injector body;

a nozzle valve member with a first closing hydraulic surface exposed to fluid pressure in said needle control chamber;

an auxiliary valve member positioned in said injector body and being movable between an open position in which said high pressure space is fluidly connected to said needle control chamber, and a closed position in which said high pressure space is blocked to said needle control chamber, and including a second closing hydraulic surface exposed to fluid pressure in said high pressure space; and a biasing spring operably coupled to bias said auxiliary valve member toward said open position.

2. The fuel injector of claim 1 wherein said second closing hydraulic surface is exposed to fluid pressure in said fuel pressurization chamber.

3. The fuel injector of claim 1 wherein said high pressure space includes a nozzle supply passage fluidly connected to said fuel pressurization chamber; and said second closing hydraulic surface is exposed to fluid pressure in said nozzle supply passage.

4. The fuel injector of claim 1 wherein said biasing spring is a first biasing spring; and wherein said fuel injector further comprises a second biasing spring operably positioned in said needle control chamber to bias said nozzle valve member toward a closed position.

5. The fuel injector of claim 1 wherein said needle control chamber is fluidly connected to a low pressure space via a vent passage.

6. A fuel injector comprising:

an injector body having disposed therein a needle control chamber and a high pressure space that includes a fuel pressurization chamber;

a nozzle valve member with a first closing hydraulic surface exposed to fluid pressure in said needle control chamber;

an auxiliary valve member positioned in said injector body and being movable between an open position in which said high pressure space is fluidly connected to said needle control chamber, and a closed position in which said high pressure space is blocked to said needle control chamber, and including a second closing hydraulic surface exposed to fluid pressure in said high pressure space;

a biasing spring operably coupled to bias said auxiliary valve member toward said open position;

said needle control chamber is fluidly connected to a low pressure space via a vent passage; and said vent passage is restrictive relative to a flow passage extending between said high pressure space and said needle control chamber.

7. A fuel injector comprising:

an injector body having disposed therein a needle control chamber and a high pressure space that includes a fuel pressurization chamber;

a nozzle valve member with a first closing hydraulic surface exposed to fluid pressure in said needle control chamber;

an auxiliary valve member positioned in said injector body and being movable between an open position in which said high pressure space is fluidly connected to said needle control chamber, and a closed position in which said high pressure space is blocked to said needle control chamber, and including a second closing hydraulic surface exposed to fluid pressure in said high pressure space;

a biasing spring operably coupled to bias said auxiliary valve member toward said open position; and said needle control chamber is a closed volume when said auxiliary valve member is in said closed position.

8. A fuel injector comprising:

an injector body having disposed therein a needle control chamber and a high pressure space that includes a fuel pressurization chamber;

a nozzle valve member with a first closing hydraulic surface exposed to fluid pressure in said needle control chamber;

an auxiliary valve member positioned in said injector body and being movable between an open position in which said high pressure space is fluidly connected to said needle control chamber, and a closed position in which said high pressure space is blocked to said needle control chamber, and including a second closing hydraulic surface exposed to fluid pressure in said high pressure space;

a biasing spring operably coupled to bias said auxiliary valve member toward said open position; and a cam driven plunger and an electronically controlled spill valve.

9. A method of increasing nozzle valve opening pressure in a fuel injector, comprising the steps of:

setting a base valve opening pressure at least in part by biasing a nozzle valve member toward a closed position with a biasing spring;

increasing fuel pressure in a high pressure space in the fuel injector for an injection event;

closing a fluid connection between the high pressure space and a needle control chamber at least in part by exposing a closing hydraulic surface of an auxiliary valve member to fluid pressure in the high pressure space;

exposing a closing hydraulic surface of said nozzle valve member to fluid pressure in the needle control chamber; and increasing the nozzle valve opening pressure above the base valve opening pressure at least in part by biasing the auxiliary valve member to open a fluid connection between the high pressure space and the needle control chamber during the increasing fuel pressure step.

10. The method of claim 9 wherein the fuel pressure increasing step includes the steps of:

moving a plunger into a fuel pressurization chamber of the high pressure space; and closing a fluid connection between the fuel pressurization chamber and a drain passage with an electronically controlled spill valve.

11. The method of claim 9 wherein the closing step includes a step of setting a valve closing pressure for the auxiliary valve member below the base valve opening pressure of the nozzle.

12. The method of claim 9 including a step of venting the needle control chamber to a low pressure space via a restricted orifice.

13. A method of increasing mean injection pressure for a fuel injection event, comprising the steps of:

pressurizing fuel in a fuel pressurizing chamber at least in part by actuating an electronically controlled pressure control valve;

opening a fluid connection between a high pressure space, which includes said fuel pressurization chamber, and a needle control chamber while fuel pressure is increasing in a fuel injector for an injection event;

exposing a closing hydraulic surface of a nozzle valve member to fluid pressure in the needle control chamber; and closing the fluid connection between the high pressure space and the needle control chamber before the nozzle valve member moves from a closed position toward an open position at least in part by exposing a closing hydraulic surface of an auxiliary valve member to fluid pressure in said high pressure space.

14. A method of increasing mean injection pressure for a fuel injection event, comprising the steps of:

opening a fluid connection between a high pressure space, which includes a fuel pressurization chamber, and a needle control chamber while fuel pressure is increasing in a fuel injector for an injection event;

exposing a closing hydraulic surface of a nozzle valve member to fluid pressure in the needle control chamber;

closing the fluid connection between the high pressure space and the needle control chamber before the nozzle valve member moves from a closed position toward an open position at least in part by exposing a closing hydraulic surface of an auxiliary valve member to fluid pressure in said high pressure space;

pressurizing fuel in the fuel injector with the steps of:

moving a plunger into the fuel pressurization chamber; and closing a fluid connection between the fuel pressurization chamber and a drain passage with an electronically controlled spill valve.

15. The method of claim 13 including a step of venting the needle control chamber to a low pressure space.

16. A method of hastening closure of a nozzle valve in a fuel injector, comprising the steps of:

setting a base closing force at least in part by biasing a nozzle valve member toward a closed position with a biasing spring;

exposing a closing hydraulic surface of the nozzle valve member to fluid pressure in a needle control chamber;

increasing a closing force above the base closing force at least in part by relieving pressure on a closing hydraulic surface of an auxiliary valve member that fluidly separates the needle control chamber from a high pressure space in the fuel injector.

17. The method of claim 16 wherein said increasing step includes the step of channeling residual fuel pressure past the auxiliary valve member and into the needle control chamber.

18. The method of claim 17 including a step of reducing fuel pressure in the fuel injector during the increasing step.

19. The method of claim 18 wherein the reducing fuel pressure step includes a step of opening an electronically controlled spill valve.

* * * * *